US006217756B1

(12) United States Patent
Martinez

(10) Patent No.: US 6,217,756 B1
(45) Date of Patent: Apr. 17, 2001

(54) DRAIN GRATE RESPONSIVE TO HIGH FLOW RATES OF WATER

(76) Inventor: Antonio Martinez, 11231 Fineview St., El Monte, CA (US) 91733

( * ) Notice: Subject to any disclaimer, the term of this patent is extended or adjusted under 35 U.S.C. 154(b) by 0 days.

(21) Appl. No.: 09/525,102

(22) Filed: Mar. 14, 2000

(51) Int. Cl.[7] ..... E03F 5/06

(52) U.S. Cl. ..... 210/163; 210/164; 210/131; 210/354; 404/4

(58) Field of Search ..... 210/163, 164, 210/131, 354; 404/4, 5

(56) References Cited

U.S. PATENT DOCUMENTS

| | | | |
|---|---|---|---|
| 248,559 | * | 10/1881 | Jackson . |
| 440,067 | * | 11/1890 | Smith . |
| 506,267 | * | 10/1893 | Sefton . |
| 1,245,903 | * | 11/1917 | Gross . |
| 1,711,674 | * | 5/1929 | Egan . |
| 5,954,952 | * | 9/1999 | Strawser, Sr. . |
| 6,015,489 | * | 1/2000 | Allen et al. . |

* cited by examiner

*Primary Examiner*—Thomas M. Lithgow
(74) *Attorney, Agent, or Firm*—Donald D. Mon

(57) ABSTRACT

A drain grate in an opening to a drain system which retains trash and debris upstream from the opening while permitting slow flow of water, and which opens completely when confronted with high rates of flow.

8 Claims, 4 Drawing Sheets

Fig. 3
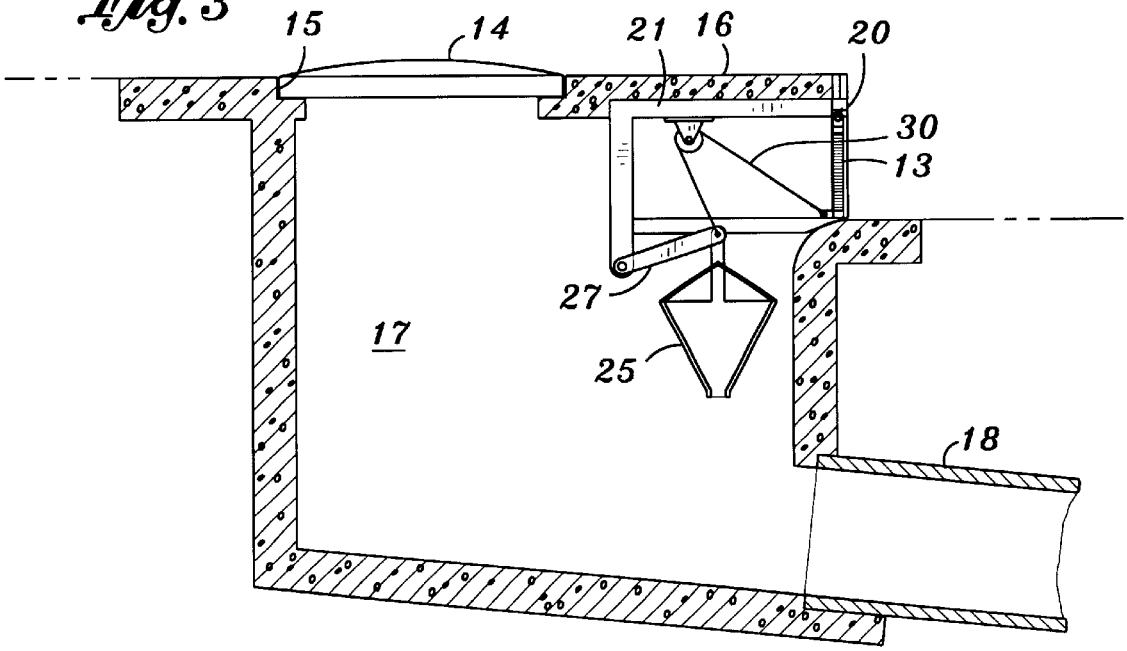
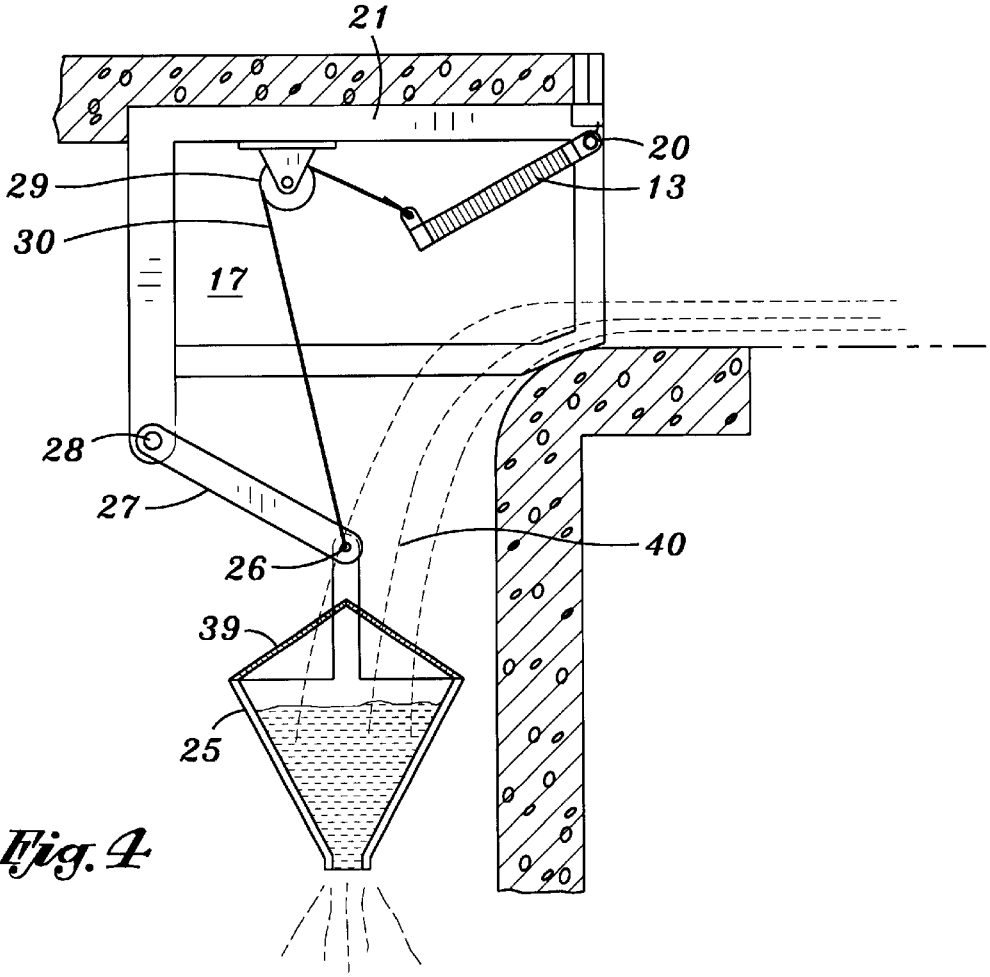
Fig. 4

Fig. 5
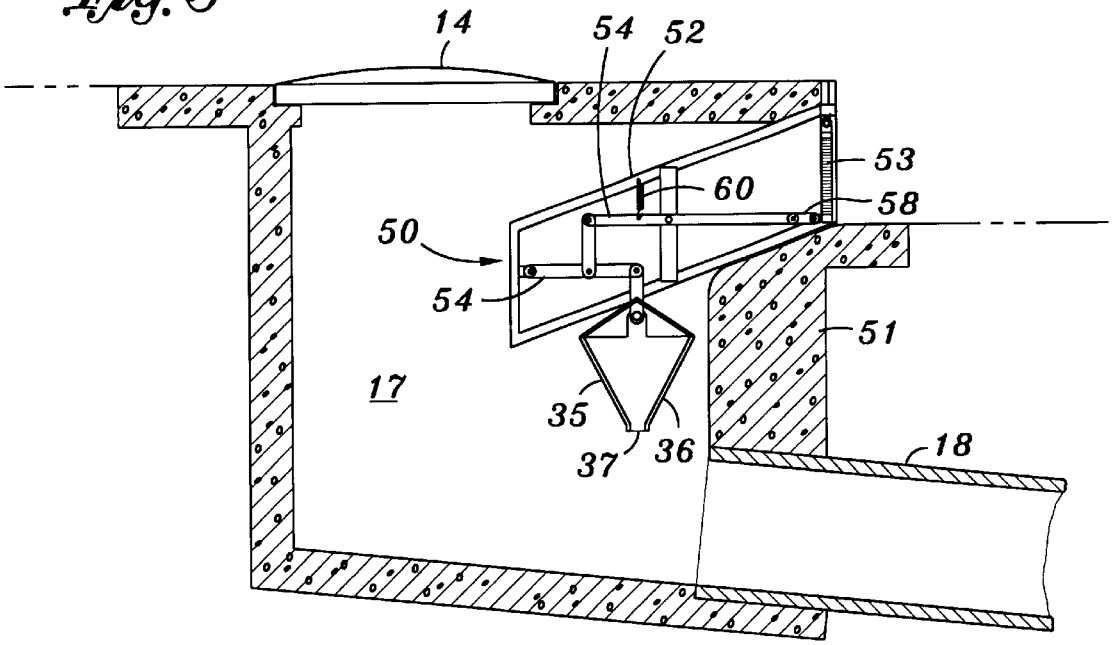
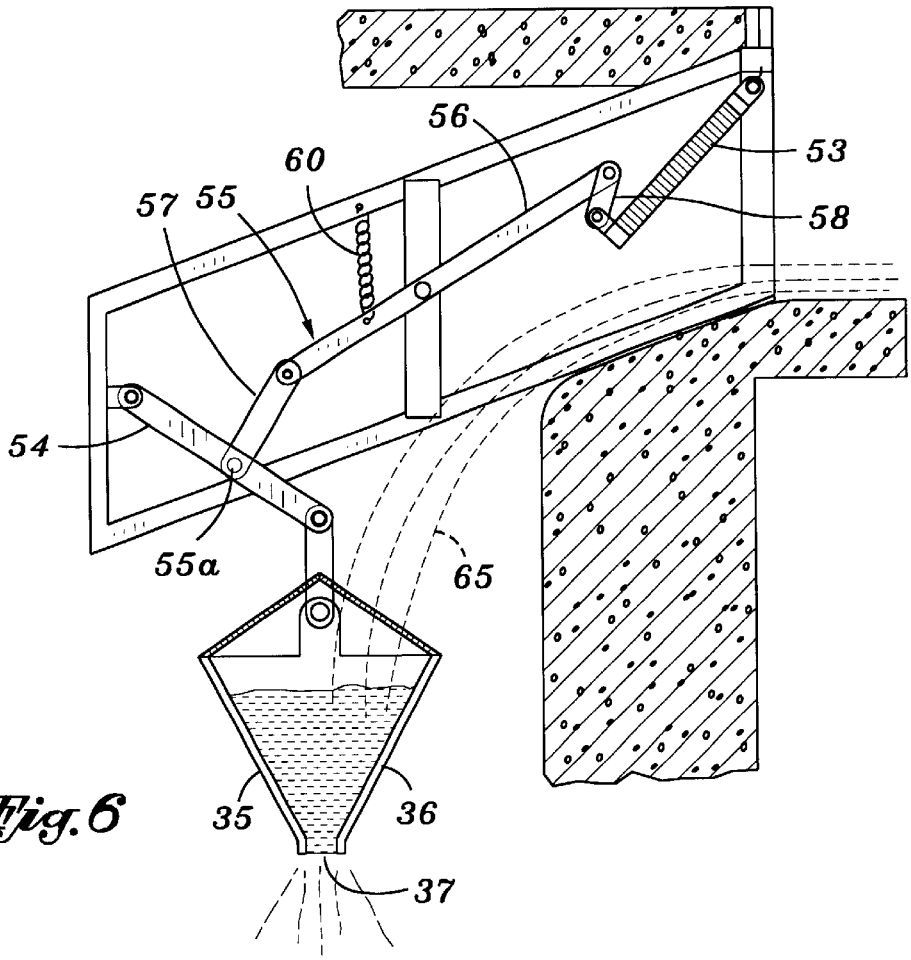
Fig. 6

DRAIN GRATE RESPONSIVE TO HIGH FLOW RATES OF WATER

FIELD OF THE INVENTION

A drain grate in an opening into a drain system which when closed retains trash and debris upstream from the opening while permitting slow flow of water, and which opens completely when confronted with high rates of water flow.

BACKGROUND OF THE INVENTION

Drainage systems that are situated in locations where trash and debris are carried along with the water are ubiquitous. In particular, unless prevented storm drains such as are found in gutters and drainage channels receive trash, cuttings, trimmings and other debris constantly throughout the year and are subject to clogging. During clement weather, the flow of water is usually rather slow, and is insufficient to flush the system, especially at catch basins and bends. Instead, despite regular sweeping upstream from the opening, considerable amounts of trash will enter the drain system, while still permitting the slow flow of water.

Serious trouble arises when later storms or other circumstances present water to these systems at high rates of flow while they are congested with the accumulated trash. Clogging of this system can result in upstream flooding, or the washing downstream of the accumulated material to do its mischief downstream. To avoid this situation, throughout the year maintenance crews are sent to clear out trash and debris that has entered the system through the openings. This is a considerable expense, and in the event that a storm strikes before the system is cleared, serious damage can occur despite those earlier efforts.

It is an object of this invention to provide a gate which will exclude trash and debris from the system while still permitting a slow flow of water, but which will open to allow full access for water (and entrained material) when the rate of flow is sufficiently high. When closed, the gate will permit the trash upstream from it to be removed by routine and collection sweeping, so as to remove trash that otherwise would later be driven into the system.

DETAILED DESCRIPTION OF THE INVENTION

This invention comprises a pivoted grate which is placed where it can occlude an opening from a drain into a collection system, or pivot to expose the opening to full flow. The grate is ported or otherwise channeled to allow water to pass through it when closed while retaining trash at low flow rates. In this condition, low flow rates such as are developed by watering of lawns, minor rains and the like are permitted, while holding back trash from the system where the trash can readily be swept away or otherwise removed without entering the drain system itself.

Under these benign conditions a linkage system which includes a variable-weight actuator allows the grate to close. When the weight increases as the consequence of a sufficiently higher rate of flow, the increased weight of the actuator will open the grate.

According to a feature of this invention, the actuator comprises a receptacle with a bleed port, which prevents the actuator from accumulating sufficient water (weight) to open the grate at slow rates of water flow, but which will accumulate sufficient water at higher rates to open the grate.

According to a preferred but optional feature of the invention, the actuator is mounted to a linkage which includes a toggle that prevents the grate from being opened by a force applied directly to the grate.

The above and other features of this invention will be fully understood from the following detailed description and the accompanying drawings, in which:

BRIEF DESCRIPTION OF THE DRAWINGS

FIG. 3 is a side view partly in cross-section, showing a simple form of the invention installed as in FIG. 1 with the grate closed;

FIG. 4 is a view like FIG. 3, except that the grate is pivoted to open the curb opening;

FIG. 5 is a side view, partly in cross-section showing the presently-preferred embodiment of a grate system in its closed position;

FIG. 6 is a view like FIG. 5 showing the system with its grate open;

DETAILED DESCRIPTION OF THE INVENTION

Figure 1:
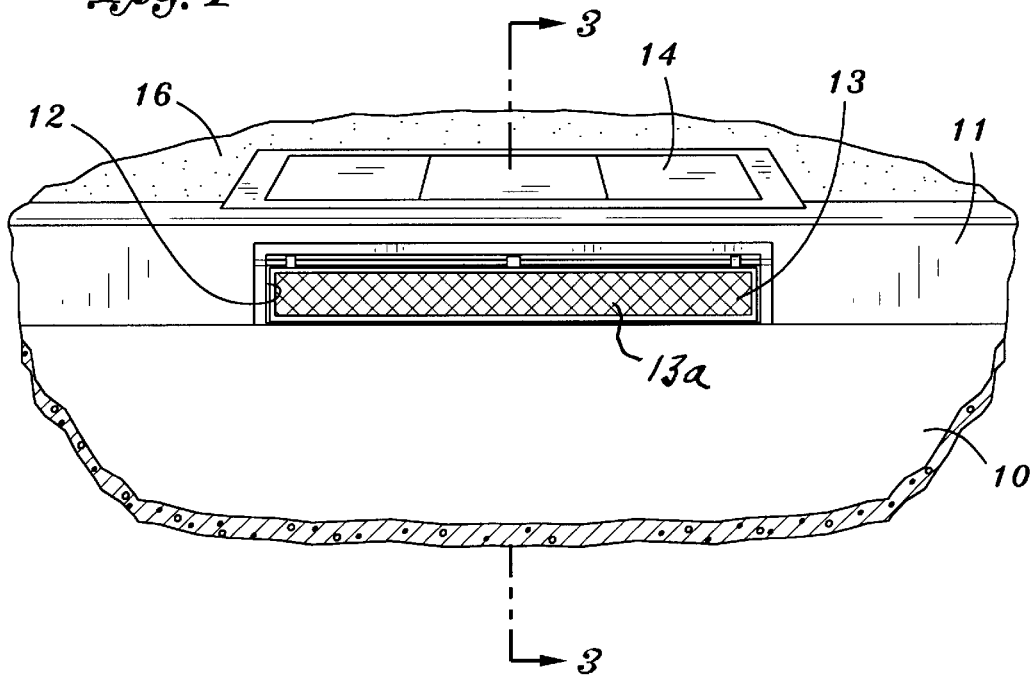
FIG. 1 is a perspective view showing a grate according to the invention installed in a curb opening, with the grate closed.
Figure 2:
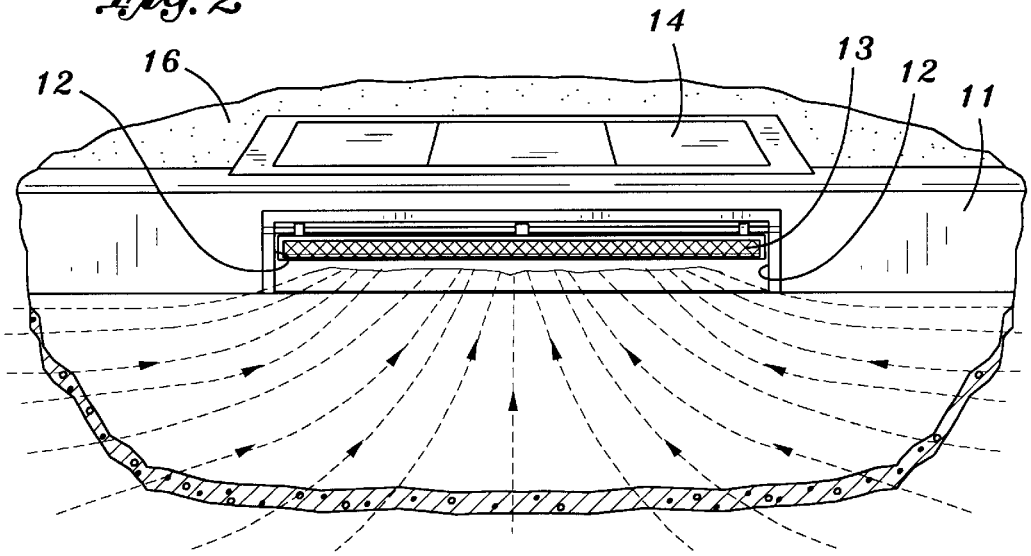
FIG. 2 is a view like FIG. 1, with the grate fully open to flow.

FIG. 1 shows a street-side installation of the invention. A typical gutter 10 and curb 11 are shown with an opening 12 to receive a grate 13. An access cover 14 is placed over an access hole 15 in the top surface 16. A collection basin 17 below hole 15 is provided to collect trash and debris which may somehow get through the opening. A pipe 18 leads to a drainage system (not shown).

Grate 13 is illustrated in FIG. 1 as a coarse screen. More frequently it may be a comb-like group of parallel rods, depending on the kind of location, and what is expected to be screened out. In any event clearances (sometimes called "gaps") are provided to enable water to flow through the grate, while retaining trash, debris and the like. The grate is not intended to act as a dam to water.

As shown in FIG. 3, grate 13 is hinged at its top by hinge 20 so it can swing inwardly and upwardly as shown in FIG. 4. A frame 21 may conveniently be emplaced to hold the device.

An actuator 25 is suspended from end 26 of a lever 27. The other end of lever 27 is hinged to the frame by hinge 28. A pulley 29 is mounted to the frame to suspend and pass a flexible cable 30. Cable 30 is attached to the free end of the grate, and to lever 27 (and thereby to the actuator).

The weight of the grate is sufficient to hold it closed against the torque exerted on it until there is sufficient weight of water in the actuator to overcome the weight of the grate itself. Additionally if preferred, a coil bias spring may be wound on the hinge 28. Alternatively, lever 27 maybe spring-biased upwardly for the same purpose.

Figure 7:
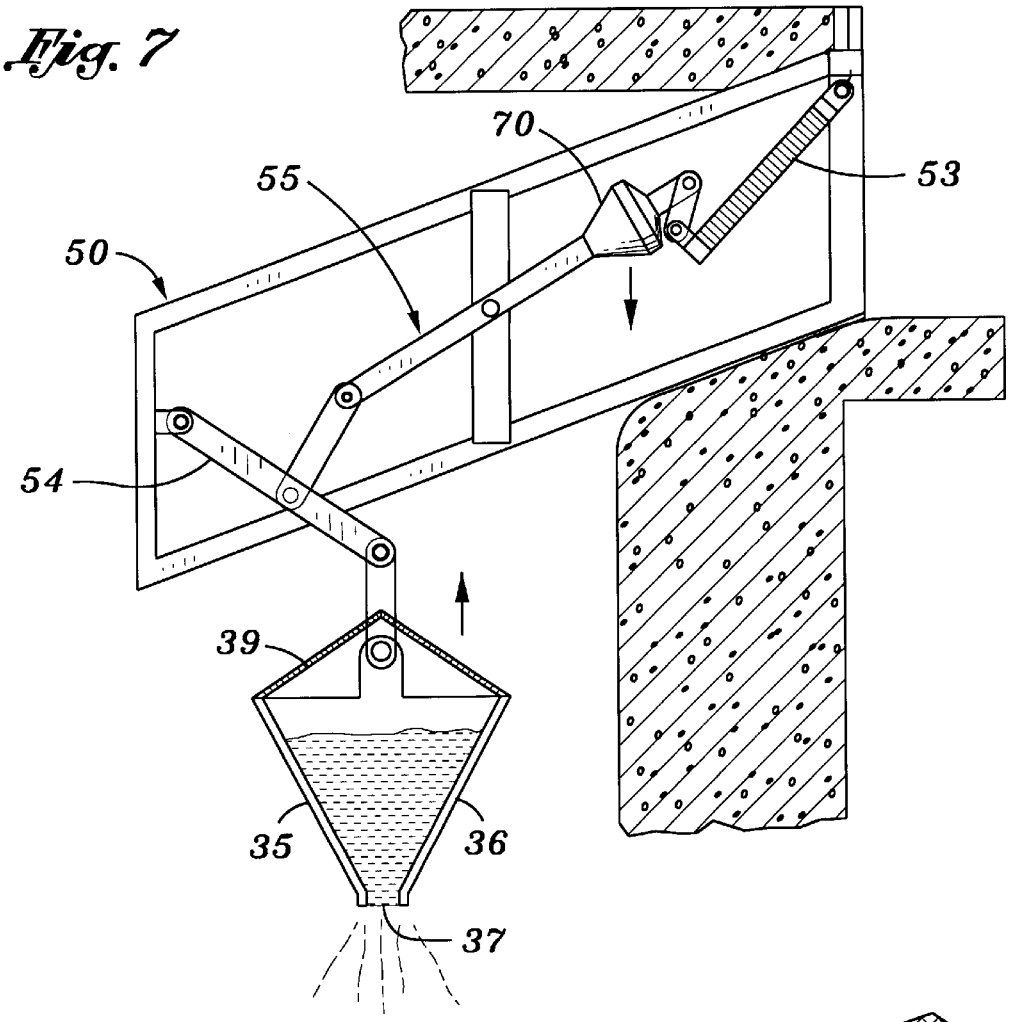
FIG. 7 is a side view partly in cross-section showing yet another system according to the invention.
Figure 8:
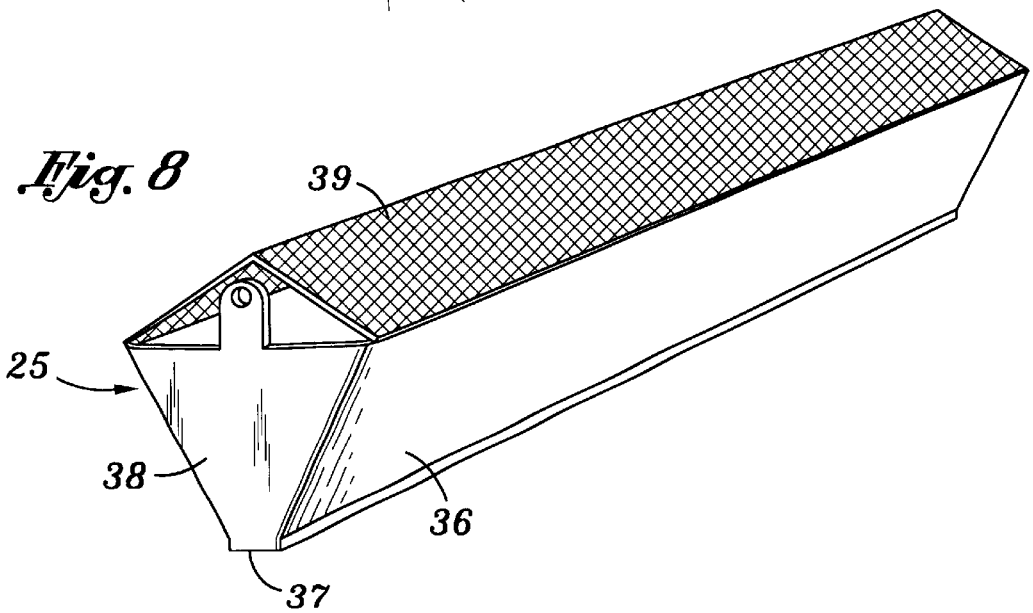
FIG. 8 is a perspective view of a preferred actuator for use in any of the embodiments.

A preferred actuator 25 is shown in FIGS.7 and 8. It is an elongated trough having a pair of sidewalls 35,36 with a bleed port 37 at the bottom of the dihedral angle which they form. The width of the port determines the resistance to flow through it. End plates 38 close the structure. A dihedral screen 39 made of screen material excludes larger debris which might clog the bleed port. Much of what is caught on this screen will be washed away by a substantial flow of water.

As can be seen from FIG. 3, very slow water flow will simply drain down the wall of the chamber, or at least not reach the actuator. In FIG. 4, it is shown how flow 40 at a sufficient rate will reach the actuator, and if sufficient to fill the actuator (which is also draining to a sufficient level), its attained weight will draw the grate open and water will continue to flow into the actuator. The grate will close again when the flow of water into the actuator is slower than the drainage flow from it.

The simple arrangement of FIGS. 1–4 in uncomplicated, but does not resist being opened by direct force on the grate. The system of FIGS. 5–7 perform as in FIGS. 1–4, but include means to prevent the opening of the grate by forces exerted from the outside.

FIGS. 5–7 disclose a very useful feature. In the embodiment of FIGS. 1–4, a sufficient push on the grate will open it. It is useful to resist this event. For this purpose a toggle is provided which will hold the grate closed unless released by a force responsive to a sufficient weight on the actuator.

FIGS. 5 and 6 show an installation 50 in a curb 51. The surrounding elements are identical and bear like numbers. Frame 52 hingedly supports grate 53. An actuator 35 is suspended, but at the end of a different linkage. As before, a lever 54 has one end pivoted to the frame and its other to the actuator. Instead of a cable, a toggle linkage system 55 joins a midsection of lever 54 at pivot 55*a*.

Toggle linkage system 55 includes a central link 56 hinged to the frame and a pair of toggle links 57,58. A bias spring 60 biases central link 56 toward its locked position (FIG. 5). Link 58 is hinged to the grate.

Examination of FIG. 5 shows that the grate will be held closed against opening by a force exerted on it from the side by by the straight-line alignment of central link 56 and toggle link 58. This toggle linkage will remain tight until the weight of the actuator overcomes the force of the bias spring and the weight of the grate itself, then it opens the toggle and the grate can open.

When the water retained in the actuator does reach the "critical" amount, the situation shown in FIG. 6 exists. Instead of a drip flow, or slow flow that does not reach the actuator, the flow 65 hits the actuator and water collects in it (less what drains from the drain port).

FIG. 7 illustrates the same system as in FIGS. 5 and 6, except that instead of a bias spring to drive the toggle system toward its locked condition, a weight 70 is attached to the central link, which exerts a constant force rather than a spring force to maintain the toggle lock. Otherwise the systems of FIGS. 5 and 7 are the same.

The operation of this system should be evident from the foregoing. The grate will be held closed to exclude trash and the like, but can pass the slow flow of water. When the rate of water flow becomes sufficient that it reaches out and fills the actuator the grate will be opened to pass whatever is presented to the opening where it is located.

This invention is not to be limited by the embodiments shown in the drawings and described in the description, which are given by way of example and not of limitation, but only in accordance with the scope of the appended claims.

I claim:

1. A grate system which closes to exclude trash and debris from passing through an opening when accompanied by water at an acceptably slow or slower rate of flow, and which opens to permit passage of such material and water when the flow rate of the water is at a faster rate which equals or exceeds said acceptable rate, said opening being formed in rigid structure where it will receive said water, said grate system comprising;

a grate hingedly mounted to said structure having a closed position across said opening, and a raised position out of said opening, said grate forming gaps permitting flow of water past it, but said gaps being so proportioned and arranged that the grate can retain objects of an objectionable size when closed;

an actuator so disposed and arranged as to receive water passed through said opening at said higher rate of flow, said actuator comprising a container having a drain opening to drain water from said actuator at a predetermined rate;

linkage mounting said actuator for upward and downward movement, so disposed and arranged as to place the actuator where it will receive water which passes through the opening at or above said higher rate of flow, and connected to said grate so as to enable the grate to extend across the opening at said slow or no rates of flow, and to move away from it at said higher rates of flow when the rate of flow into the actuator sufficiently exceeds the rate of drainage through said drain port.

2. Apparatus according to claim 1 in which the weight of said grate opposes the force of said actuator.

3. Apparatus according to claim 1 in which said linkage comprises a cable linked to said actuator and to said grate.

4. Apparatus according to claim 3 in which said actuator is mounted to a lever, said lever being mounted to said structure, and in which a pulley mounted to said structure supports and passes said cable.

5. Apparatus according to claim 1 in which said linkage includes a toggle link that maintains the grate closed against upstream forces exerted directly on the grate.

6. Apparatus according to claim 5 in which a spring biases said linkage toward its closed position.

7. Apparatus according to claim 5 in which a weight biases said linkage toward its closed position.

8. Apparatus according to claim 5 in which said toggle includes a center link pivotally mounted to said structure, a link functionally connected to said actuator, and a link attached to said grate, whereby the closed position the center link is prevented from rotation unless the actuator has a sufficient weight.

* * * * *